US005501839A

United States Patent [19]

Tarantino

[11] Patent Number: 5,501,839

[45] Date of Patent: Mar. 26, 1996

[54] BEAKER COVER

[75] Inventor: Elia R. Tarantino, Reno, Nev.

[73] Assignee: ID Technology, Reno, Nev.

[21] Appl. No.: 418,739

[22] Filed: Apr. 7, 1995

[51] Int. Cl.[6] ..... B01L 3/00

[52] U.S. Cl. ..... 422/99; 422/102

[58] Field of Search ..... 215/353, 355; 220/201, 213, 254; 222/572 X; 422/99, 102; 435/296, 297, 298, 299

[56] References Cited

U.S. PATENT DOCUMENTS

| | | | |
|---|---|---|---|
| 612,750 | 10/1898 | McDougall | 222/572 |
| 1,920,385 | 10/1930 | Hamilton | 220/254 |
| 2,694,033 | 5/1953 | Fletcher | 435/298 |
| 3,286,867 | 10/1965 | Mumford | 215/353 |
| 4,586,622 | 5/1986 | Walldorf | 220/254 |
| 4,726,478 | 2/1988 | Zimmermann | 222/572 |
| 4,871,077 | 10/1989 | Ogden et al. | 220/254 |
| 5,341,969 | 8/1994 | Accardo et al. | 222/572 |
| 5,346,672 | 9/1994 | Stapleton et al. | 422/99 |

OTHER PUBLICATIONS

Supercool, Inc., Product Brochure.

*Primary Examiner*—Jill Warden
*Assistant Examiner*—Sharidan Carrillo
*Attorney, Agent, or Firm*—Townsend and Townsend and Crew

[57] ABSTRACT

A cover for a laboratory beaker is formed from a top structure having a depending, annular skirt that forms, with the frustoconically shaped top structure, a peripheral shoulder. The skirt is dimensioned to be received by the opening of beaker to hold the cover in place, and to close any poring spout that may be formed in the periphery of the beaker. The shoulder is dimensioned to rest on the periphery of the beaker. Formed in top structure is an aperture that allows ingress to the beaker when the cover is in place. A stopper is provided to be removably received by the aperture to close the interior of the beaker. The a bottom portion of the stopper is structured to depend from the top structure, toward the volume of the beaker covered by the cover to provide a formation for reflux activity.

13 Claims, 1 Drawing Sheet

BEAKER COVER

BACKGROUND OF THE INVENTION

The present invention is directed to a cover for a laboratory beaker.

Beakers for laboratory use are configured as wide cylindrical glass vessels usually with a pouring lip formed at the periphery of the beaker that defines the opening to the interior volume thereof. Beakers are used as laboratory containers and mixing jars for a variety of solutions, compounds, and chemicals. While they are used to mix various solutions, they are usually not used if there is to be a reaction for the reason that unless covered the reaction can cause some of the solution to splash out of the beaker. One alternative to resolving this splashing problem is to use whatever may be at hand in a laboratory as a cover, such as a petri dish, a shallow, circular (usually glass) dish that fits loosely over the opening of the beaker. Unfortunately, the shape of the petri dish (i.e., its shallowness) lends itself to sitting loosely on the beaker, making the dish susceptible to being brushed or knocked off the beaker and broken. Further still, in order to gain access to the beaker's content or volume for adding material, or to insert e.g., a thermometer, the dish must be removed.

Additionally, while beakers are used to heat solutions, they are frequently not so used if the chemical composition of the solution must be maintained at some constant level for the reason that it is difficult to inhibit loss of the solution by evaporation. Attempting to cover a beaker with a petri dish to contain the evaporation offers a poor alternative because the shallow shape of the petri dish prevents is from closing the beaker's pour spout, thereby leaving egress for evaporation vapors.

Flasks are more often used for containing chemical reactions by fitting them with a condenser of one type or another that allows a reflux activity to occur to protect the heated solution against evaporation. Thereby, the solution's chemical concentration is maintained by retaining and condensing evaporation for return to the solution. However, such condensers are often an elaborate, relatively expensive devices so that any laboratory environment will have only a few, if any. Further, they are constructed for use principally with flasks.

Thus, it can be seen that there is a need for a beaker cover that can operate to substantially enclose the volume of a beaker to inhibit the escape of vapors from the contents of the beaker.

SUMMARY OF THE INVENTION

The present invention is a beaker cover that is designed to substantially enclose the volume of a standard laboratory beaker, yet permit access thereto for adding to the content of the beaker, or for selectively allowing introduction of a measurement device, such as a thermometer, without removing the cover. Additionally, the beaker cover of the present invention includes a mechanism that permits a proper reflux action to take place. Finally, the structure of the beaker cover of the present invention is such that it can be inexpensively constructed so that a number of such beaker covers can be kept on hand.

Broadly, the beaker cover of the present invention comprises a top structure formed to overlie the beaker, and having a depending skirt dimensioned to close off any pouring spout of the beaker. The top structure defines a space above the beaker, and includes structure that permits and enhances reflux activity.

In the preferred embodiment of the invention the top structure in frustoconically shaped with an opening formed in an upper portion thereof to provide access to the beaker. The depending skirt is an annular sidewall formed on the lower periphery of the top structure, and dimensioned to juxtaposedly confront the interior surface of the upper portion of the beaker and proximate its rim.

A stopper or plug is provided to be removable placed in, and thereby close, the opening formed in the top structure. The stopper is constructed to have a lower end portion that protrudes into the space of the top structure when inserted in the opening, producing a mechanism for reflux activity for a heated solution contained by the covered beaker. The stopper may be removed, allowing the opening to provide access to the beaker and its contents for either adding to those contents or for insertion of a measurement element such as a thermometer.

In one embodiment of the invention the opening is formed with an interior surface in the shape of an inverted cone, with the stopper being correspondingly shaped for mating engagement with the structure of the opening.

In a further embodiment of the invention the stopper is constructed with a cavity that can receive a coolant, such as ice, to operate to enhance reflux activity.

In a yet further embodiment of the invention, the stopper is a cone-shaped thermoelectric system constructed to provide a cooling external surface for reflux activity.

It should be evident to those skilled in this art that the present invention provides a number of advantages. First, but not necessarily foremost, is that the skirt operates to hold the beaker cover in place, covering the beaker, while at the same time effectively closing the beaker to restrict and otherwise prevent evaporation of the solution contained by the covered beaker. The skirt closes any pour spout the beaker may have, and holds the beaker cover in a manner that prevents it from being easily brushed off.

A further advantage of the present invention is that the stopper may be left in place to enjoy the advantages described above, or removed, even temporarily, to provide access to the solution contained within the beaker for measurement purposes, or to add to that content.

These and other advantages and features of the invention will become apparent to those skilled in this art upon a reading of the following description of the preferred embodiment of the invention, which should of course be taken in conjunction with the accompanying drawings.

DESCRIPTION OF THE PREFERRED EMBODIMENT

Figure 1:
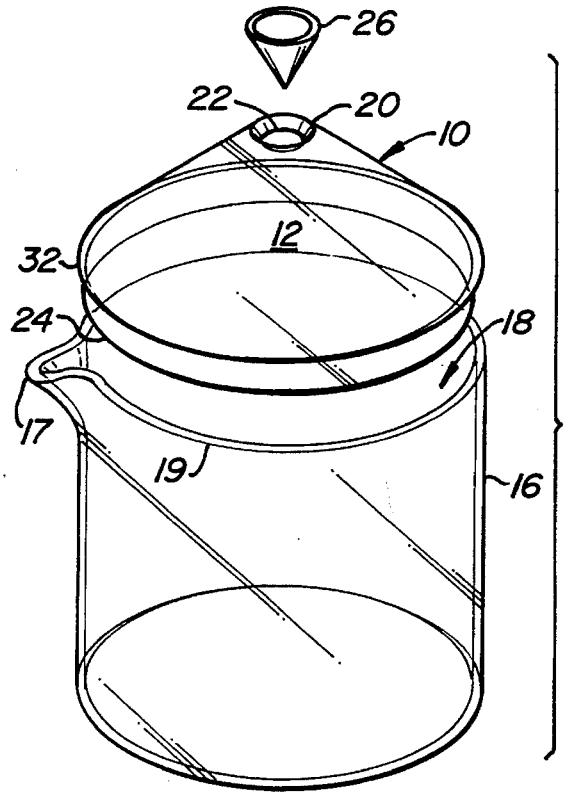
FIG. 1 is a perspective view of a beaker to be covered by the beaker cover of the present invention with an associated stopper.

Turning now to the figures, and in particular FIG. 1, illustrated is a beaker cover, designated generally with the reference numeral 10, constructed according to the teachings of the present invention. As shown, the beaker cover 10 is constructed from a frustoconical-shaped top structure 12 that defines an interior space 14 ( better seen in FIG. 2) that will overly the volume 18 of a beaker 16 when the beaker cover 10 is placed in its operating position to cover the beaker 16. (The beaker 16 is of conventional design, having an upper opening to the volume 18 defined by a rolled lip or edge 19 that includes a pour spout 17.)

Figure 3:
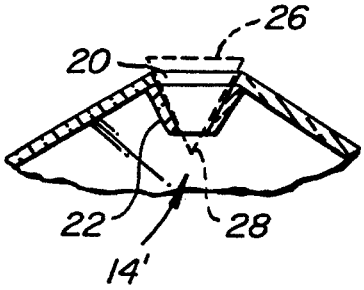
FIG. 3 illustrates a cone shaped opening formed in the beaker cover that operates as a funnel to facilitate addition to the content of the beaker being covered by the beaker cover of the present invention.

Formed at the upper portion of the beaker cover 10 is an opening 20 that provides access to the underlying volume 18 of the beaker 16. The opening 20 allows material to be introduced into the beaker 16 covered by the beaker cover 10. Alternatively, the opening 20 permits admittance of measurement devices, such as a thermometer, to allow various measurements to be taken of the solution or content of the beaker 16. In order to facilitate the introduction of material to the solution contained by the beaker 16, the opening 20 may include a cone formation 22, as illustrated in FIG. 3. So formed, the cone formation 22 provides the opening 20 with a funnel through which material can be added to the solution in an underlying beaker 16.

To close the opening, when necessary or desired, a plug or stopper 26 is provided. The stopper 26 is cone-shaped, although other shapes may also be used. The stopper 26 includes an bottom portion 28 that is dimensioned to extend into the space 14 defined by the top structure 12 when the stopper 26 is placed to close the opening 20. By extending into the space 14 as it does, above the volume 18 of the beaker 16, the bottom portion 28 provides a formation whereat reflux action can take place should the content of the beaker 16 be heated. Further, closing the opening 20 by the stopper 26 inhibits evaporation of the heated content of the beaker 16, and operates to maintain the concentration of the content.

In the case of an opening 20 that is provided a cone formation 22 (FIG. 3), it is preferred that the stopper 26 be dimensioned so that the bottom portion 28 extend out of the cone formation 22 and into the space 14' defined by the top structure 12 as shown in FIG. 3. The cone formation 22 and the bottom portion 28 operate together close the beaker cover and to provide the mechanism for reflux activity when necessary.

The stopper 26 may be of solid construction, or preferably, as illustrated in the Figures, it may be constructed to include a cavity 30. The cavity 30 functions to contain a coolant so that when the stopper 26 in situated in the opening 20 to close beaker cover 10 (FIG. 2), the stopper 26 thereby forms, what is called in the art, a "cold finger" that enhances reflux activity by condensing any evaporation produced by the heated content of the beaker 16, and returning the condensation to that content. The coolant introduced into the cavity 30 may be conventional ice or other alternatives as the situation may call for.

Returning to FIG. 1, the top structure 12 of the beaker cover 10 includes, formed on the lower periphery 32 thereof, an annular wall or skirt 34. The skirt 34 is configured to be inserted in and depend into the beaker 16. Preferably, the skirt 34 has a dimension (d) sufficient so that the skirt extends far enough into the beaker 16 to close the pour spout 17 formed on the lip 19.

In addition, the skirt 34 preferably has a diameter less that of the lower periphery 32 so that a shoulder 36 (FIG. 2) is formed by the top structure 12 and the skirt 34. The shoulder 36 is dimensioned to overlap the rim 19 of the beaker 16 when the beaker cover 10 is in place, covering the beaker 16. The shoulder 36 operates to hold the beaker cover 10 in place on the beaker 16. Preferably, the dimensions of the beaker cover 10, and particularly the skirt 34 and shoulder 36, are such that the beaker cover 10 forms with the beaker an effective enclosure for the content of the beaker with a minimum of leakage for the escape of evaporation. However, the skirt should also be dimensioned to be easily inserted snugly in place to cover the beaker 16, yet at the same time be subject to easy removal.

Figure 2:
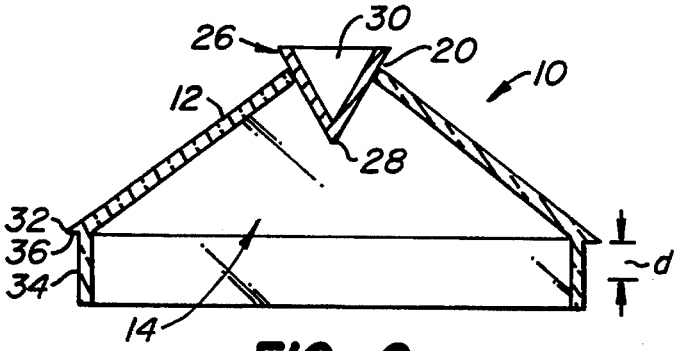
FIG. 2 is a sectional view of the beaker cover of the present invention, showing placement of the stopper to close the opening formed in the beaker cover.
Figure 4:
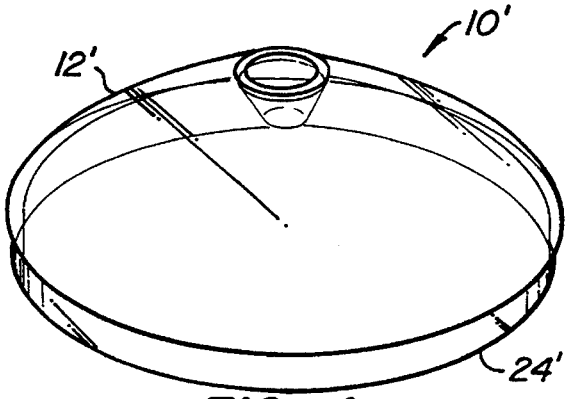
FIG. 4 is a perspective view of an alternate form of a beaker cover according to the present invention.

The shape of the beaker cover 10 is preferably conical (actually, frustoconical, as illustrated in FIGS. 1–3), formed with an angle of incline approximately 60 degrees from vertical, although other angles of incline may be used. Also, the beaker cover 10 may take on other shapes, such as the hemispherical configuration illustrated in FIG. 3.

Preferably, the beaker cover 10 is constructed from glass, and is unitary, although other constructions and materials (e.g., porcelain) can be used. Similarly, the stopper 26 can be constructed of glass or other material.

Figure 5:
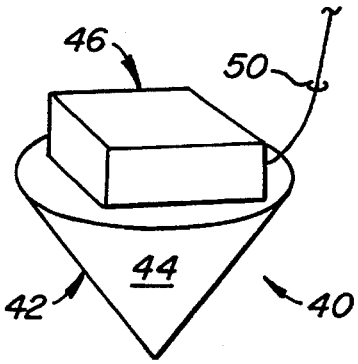
FIG. 5 is an illustration of an alternate embodiment of the stopper formed from a thermoelectric system and used to close the opening formed in the beaker cover of FIG. 1.

Turning now to FIG. 5, an alternate embodiment of the stopper 26 is shown, designated in FIG. 5 with the reference numeral 40. The stopper 40 is manufactured as a thermoelectric system according to known principles. Briefly, one form of thermoelectric system uses bismuth teluride, doped to obtain positive (p) and negative (n) semiconducting properties. A number of pn-couples, thermally parallel and electrically in series, are arranged between ceramic plates to establish a temperature difference between a warm side and a cold side of a single stage module. Such thermoelectric systems are manufactured by Supercool, Inc. of San Rafael, Calif.

Thus, the stopper 40 is constructed as a thermoelectric system so that the body 42 of the stopper 40 forms the thermoelectric module with the outer conical surface 44 of the body 42 forming the cool plate of the system. A heat exchanger subassembly 46 mounts to the body 42, and functions to dissipate heat. Heat dissipation maybe to the air in the surroundings by, for example, fans (not shown) contained in, or forming a part of, the heat exchanger subassembly. Alternatively, a liquid system (not shown) may be used to dissipate heat. Power is coupled to the thermoelectric modules by an electrical line 50.

In operation, electrical power is supplied the thermoelectric module forming the body 42 via the electrical line 50. The heat exchanger subassembly 46 establishes one side of the at a particular temperature by heat dissipation, causing in turn the cool plate, the surface 42, to assume some lower temperature as established by the electrical power supplied. (A single stage cascade module arrangement can establish an approximately 70 degree (Centigrade) maximum temperature differential between the warm and cold sides of the thermoelectric module.) The temperature of the body surface 44, therefore, depends in part upon the amount of current supplied the thermoelectric module forming the body 42. (It also depends upon the particular heat exchange system used, e.g., a water system, or an air system using fans, the latter system, in turn, will be dependant somewhat upon the ambient air temperature of the environment in which the stopper 40 is used.) It can be seen, therefore, that a stopper formed as a thermoelectric system provides a method of regulating the temperature of the portion of the body 42 that forms a "cold finger" for reflux activity when the stopper 40 is installed in the opening 20 of the beaker cover 10 (FIG. 1).

While a full and complete disclosure of the invention has been provided herein above, it will be obvious to those skilled in the art that various modifications and changes may be made. For example, it will be apparent that if leakage can be tolerated, the dimensions of the skirt 34 and periphery 32 could be constructed to cover variously sized beakers, operating to provide an effective evaporation-inhibiting cover for beakers having a smaller openings, yet still be used as a cover for beakers with larger opening. In the later cases, however, evaporation-inhibiting ability of the cover is diminished, altogether still in existence to some extent.

What is claimed is:

1. A beaker cover for covering and enclosing a containment volume of a beaker having an upper periphery defining an opening to the containment volume, comprising:

a top structure configured with an interior surface formed to overlie the containment volume of the beaker, and having an opening therethrough to permit access to the containment volume;

an annular skirt formed to depend from the top structure and to be accepted into the beaker;

wherein the top structure includes a bottom periphery that forms with the annular skirt a shoulder to rest upon the upper periphery of the beaker; and a stopper configured to be accepted in the opening of the top structure, closing the opening, the stopper comprising a cavity containing a coolant wherein said stopper provides a structure for reflux activity.

2. The beaker cover of claim 1, wherein the opening is formed by a frustoconical surface having an upper exterior opening and a lower interior opening when placed to cover the beaker.

3. The beaker cover of claim 2, wherein the frustoconical surface is formed so that the upper exterior opening is larger than the lower interior opening.

4. The beaker cover of claim 1, wherein the coolant is frozen.

5. The beaker cover of claim 1, wherein the coolant is water.

6. The beaker cover of claim 1, wherein the top structure has a frustoconical configuration, forming a frustoconical interior surface.

7. The beaker cover of claim 6, wherein the interior surface of the top structure is concave.

8. The beaker cover of claim 1, wherein the top structure is a hemispherical configuration.

9. The beaker cover of claim 1, wherein the upper periphery of the beaker is formed to include a pour spout that protrudes outward from the upper periphery, and wherein the skirt is dimensioned to close the pour spout.

10. A beaker cover, comprising:

a top structure configured with an interior surface forming a volume to overlie the beaker, and having an opening therethrough to permit access to the volume; and an annular skirt formed to depend from the top structure and to be accepted into the beaker;

wherein the top structure includes a bottom periphery that forms with the annular skirt a shoulder to rest upon an upper periphery of the beaker; and a stopper formed and configured to be accepted in the opening of the top structure, closing the opening, and wherein the stopper includes a thermoelectric system having an outer surface at least a portion of which is formed to extend through the lower interior opening and into the volume.

11. A cover for a beaker of the type having an opening defined by a peripheral portion configured to form a pour spout, the cover comprising:

a top structure constructed with a bottom periphery to form a volume to overlie the opening for enclosing the beaker and having an aperture that provides ingress and egress to and from the volume and underling beaker through the aperture;

an annular wall formed to the bottom periphery to enclose the interior of the beaker to inhibit egress through the pour spout; and a stopper removably inserted in the aperture, the stopper comprising a cavity containing a coolant and a body portion that extends through the aperture.

12. The cover of claim 11, wherein the coolant is in a solid form.

13. The cover of claim 11, wherein the coolant is water.

* * * * *